US007325599B2

(12) United States Patent
Barker

(10) Patent No.: US 7,325,599 B2
(45) Date of Patent: Feb. 5, 2008

(54) SAFETY SHIELD FOR ROTARY DRILLING RIGS

(76) Inventor: John Barker, 61 Neville Close, Red Deer, AB (CA) T4P 1T8

( * ) Notice: Subject to any disclaimer, the term of this patent is extended or adjusted under 35 U.S.C. 154(b) by 141 days.

(21) Appl. No.: 11/261,479

(22) Filed: Oct. 31, 2005

(65) Prior Publication Data

US 2007/0095526 A1 May 3, 2007

(51) Int. Cl.
*E21B 41/00* (2006.01)

(52) U.S. Cl. ..... 166/81.1; 175/219

(58) Field of Classification Search ..... 166/78.1, 166/79.1, 81.1; 175/195, 219
See application file for complete search history.

(56) References Cited

U.S. PATENT DOCUMENTS 2,214,429 A * 9/1940 Miller ..... 166/81.1
2,634,812 A * 4/1953 Allemang ..... 166/81.1
3,270,810 A * 9/1966 Johnston ..... 166/84.1
3,322,198 A 5/1967 McHendry
4,210,213 A * 7/1980 Louviere ..... 175/195
4,285,215 A * 8/1981 Roeder ..... 464/163
5,551,511 A * 9/1996 Holtby ..... 166/81.1
6,119,772 A * 9/2000 Pruet ..... 166/81.1

FOREIGN PATENT DOCUMENTS

CA 2395963 3/2004

* cited by examiner

*Primary Examiner*—Kenneth Thompson
(74) *Attorney, Agent, or Firm*—Oyen Wiggs Green & Mutala LLP

(57) ABSTRACT

This invention relates to a novel safety shield for rotary drilling rigs. More particularly, the invention pertains to a portable, clam-shell style extendible leg safety shield which can be readily installed on the ground around the drill stem of an operational drilling rig, such as an oil well drilling rig. A safety shield for use in association with rotary drilling rigs comprising (a) a first protective shield; (b) a second protective shield hinged to the first shield; (c) a first leg assembly connected to the exterior of the first shield; (d) a second leg assembly secured to the exterior of the second shield; and (e) a securing mechanism for securing the first shield to the second shield.

10 Claims, 6 Drawing Sheets

12
39
20
48
36
A
A
39
20
48

44
46
20

SAFETY SHIELD FOR ROTARY DRILLING RIGS

FIELD OF THE INVENTION

This invention relates to a novel safety shield for land based rotary drilling rigs. More particularly, the invention pertains to a portable, clam-shell style extendible leg safety shield which can be readily installed in the bottom of the cellar below the drilling floor and around the drill stem of an operational land based drilling rig, such as an oil or gas well drilling rig, when drilling the surface hole section of an oil or gas well when no conductor pipe has been preset.

BACKGROUND OF THE INVENTION

Drilling oil or gas wells with a drilling rig is a hazardous activity. One of the components of the drilling rig which creates a safety hazard to the workmen (roughnecks) is the exposed rapidly rotating drill stem. Regulators in certain jurisdictions have passed regulations which require employers to safeguard their workmen from accidentally coming into contact with moving parts of machinery or equipment that may be hazardous.

When an oil well is being drilled, it is customary, if the top layer of the formation to be drilled is gravel or if exceptional pressures are to be encountered, to set a conductor pipe in the hole extending the depth of the gravel to hold the gravel away from the drill stem or deal with the excess pressure. In other cases, however, where top formation gravel or exceptional pressures are not encountered, and to save time and money, the drill hole is started directly in the ground (spudded) and continues downwardly through the successive strata formations without a conductor pipe being set, until a suitable depth is reached to set the surface casing. The surface casing must be set in a competent formation and successfully cemented full length so that blow out preventers can be installed.

When an oil or gas well is being drilled, drilling mud is used to control formation pressures, cool the drill bit and remove formation cuttings (shale) generated by the rotating drill bit as it cuts downwardly through the strata formations. As the well is being drilled, the drilling mud is pumped downwardly through the interior of the rotating drill stem, which is hollow, and exits from the bottom of the rotating drill bit, which is of a diameter larger than the drill pipe. The drilling mud with shale cuttings returns to the surface in the annular space between the formation and the rotating drill stem. Since the returned drilling mud contains cuttings, the shale contaminated mud is pumped by a trash pump to a shale shaker where the shale is separated from the drilling mud. The mud from the shale shaker, with cuttings removed, is pumped by a mud pump to the top of the drill stem where it is again pumped down the interior of the rotating drill stem to the drill bit. The drilling mud is thus in continuous circulation while the well is being drilled.

When a drill hole is spudded without a conductor pipe being set, an annular space is created between the rotating drill stem and the surrounding ground. This annular space is usually filled with drilling mud which is being returned from the bottom of the hole. The drilling mud obscures the fact that there is an annular hole between the rotating drill stem and the surrounding ground.

While the well is being drilled, the rapidly rotating drill stem of the drilling rig and the annular hole in the ground around the rotating drill stem, as obscured by drilling mud, creates a potential safety hazard. Conditions under the platform floor are often wet and slippery from drilling mud and other debris that is spilled on the ground. Not infrequently, it is necessary for a rig worker to go below the drill deck and shovel or hose away debris and other unwanted materials from the area around the rotating drill stem. In such conditions, it is easy for the rig worker to lose his footing and fall, in some cases against the rotating drill stem and support apparatus. In other cases, the rig worker may inadvertently step into the obscured annular hole and contact the rotating drill stem or get his clothing caught in the rotating drill stem. Serious injury to the worker can then result. Sometimes, electrical equipment with electrical cord has to be taken below deck. The cord can become entangled in the rotating drill stem. Another problem that can occur in the drilling of oil wells is that unwanted articles can fall down the well bore. In such cases, drilling has to undergo a costly shut down while the unwanted articles are fished from the well bore.

U.S. Pat. No. 3,322,198, W. L. McHendry, issued May 30, 1967, discloses a safety device for enclosing a blowout preventer that has been fitted with a rotating head (pack-off). It is a second shield for venting any dust particles or gas that may get by the pack-off unit in the event of expiry of the rubber pack-off element. A blowout preventer is used while drilling the main section of an oil or gas well and can only be installed after the surface hole section (a larger diameter hole) is drilled and the surface casing is set and cemented full length. The surface casing is then cut and a casing head (flange) is welded on. The blowout preventer is then installed on the casing head. The McHendry device is useful only when air or mist drilling is being done on the main drill hole section. Air or mist drilling reduces drilling costs by increasing penetration rates but can only be done in areas that are known not to have a risk of formation water entering the wellbore. When drilling with air or mist and water is encountered, the well must be then filled with drilling mud which is circulated back to the shale shaker in a conventional procedure. In such cases, the air or mist drilling method cannot be continued. The device disclosed by McHendry comprises a split closable hood adapted to be mounted on the drilling head. The hood has a pair of open end portions. One of the end portions includes a mechanism for clamping the hood in a substantially sealed relation about a portion of the drilling head. The other of the end portions includes a collar and a flexible baffle inwardly directed from the interior surface of the collar. The baffle has a hole therein for accepting the drill string of the well drilling apparatus and for permitting entry of air into the hood. Means for withdrawing air and particles from the interior of the hood for controlled disposal is also included. The safety device is designed to fit around the blowout preventer at a fixed elevation and does not have legs which enable the height of the safety device to be adjusted.

Canadian Patent Application No. 2,395,963, N. D. Denis, filed Sep. 6, 2002, discloses a mesh-like percussive or rotary rock drill guard that is designed to keep a driller or operator away from the rotating drill rod of a seismic drilling rig. The guard is mounted on a rock drill mast and is connected to the rotation lever of the drill. Doors mounted on the mast will automatically encase the complete drill and drill rod upon activating any rotation lever. The guard does not have extendible legs which enable the elevation of the guard to be adjusted or plumbed. Seismic drilling rigs are small and portable compared to oil well drilling rigs which employ heavy and massive equipment.

The foregoing examples of the general art and limitations related thereto are intended to be illustrative and not exclusive. Other limitations of the related art will become apparent to those of skill in the art upon a reading of the specification and a study of the drawings.

SUMMARY OF THE INVENTION

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

The invention is directed to a safety shield for use in association with rotary drilling rigs comprising: (a) a first protective shield; (b) a second protective shield associated with the first shield; (c) a first leg assembly connected to the exterior of the first shield; (d) a second leg assembly secured to the exterior of the second shield; and (e) a securing mechanism for securing the first shield to the second shield.

The first protective shield and the second protective shield can be formed in the shape of hollow conical half shells, which when placed together form a hollow truncated cone. The first protective shield and the second protective shield can be hinged together.

The first and second leg assemblies can be extendible. The first leg assembly and the second leg assembly can be secured to the exterior of the first and second half shells by a series of mounts.

The safety shield can include a pair of leg assemblies secured to the exterior of the first shell and a pair of leg assemblies secured to the exterior of the second shell. The safety shield can include a handle mounted on the exterior of the first shell and a handle mounted on the exterior of the second shell.

The first and second leg assemblies can be formed of an outer component and an inner second component which can be moved relative to the outer component. The outer component can have a slot therein and the inner component can have a handle which can protrude through the slot and enable the inner component to be moved in the slot relative to the outer component. The handle can be locked into position in the outer component. The outer component can have a lock slot therein in which the handle of the inner component can be locked.

In addition to the exemplary aspects and embodiments described above, further aspects and embodiments will become apparent by reference to the drawings and by study of the following detailed descriptions.

BRIEF DESCRIPTION OF DRAWINGS

Exemplary embodiments are illustrated in referenced figures of the drawings. It is intended that the embodiments and figures disclosed herein are to be considered illustrative rather than restrictive.

DETAILED DESCRIPTION OF THE INVENTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

The device safety shield, according to the invention has a two part conical clam-shell construction and with adjustable length legs is adapted to be readily installed on the ground around the rotating drill stem below the floor of the oil well drilling rig. The shield provides a protective cover around the drill stem and ancillary drilling equipment and prevents a drilling rig worker (roughneck), when he goes below the drilling rig platform, from being injured by inadvertently stepping into the annular hole around the rotating drill stem, as obscured by the drilling mud, and contacting the rotating drill stem or contacting the drill stem with a shovel or other instrument and getting injured. The shield, particularly with an optional top screen, can prevent objects from falling down the drill hole, thereby avoiding an expensive "fishing" operation.

Figure 1:
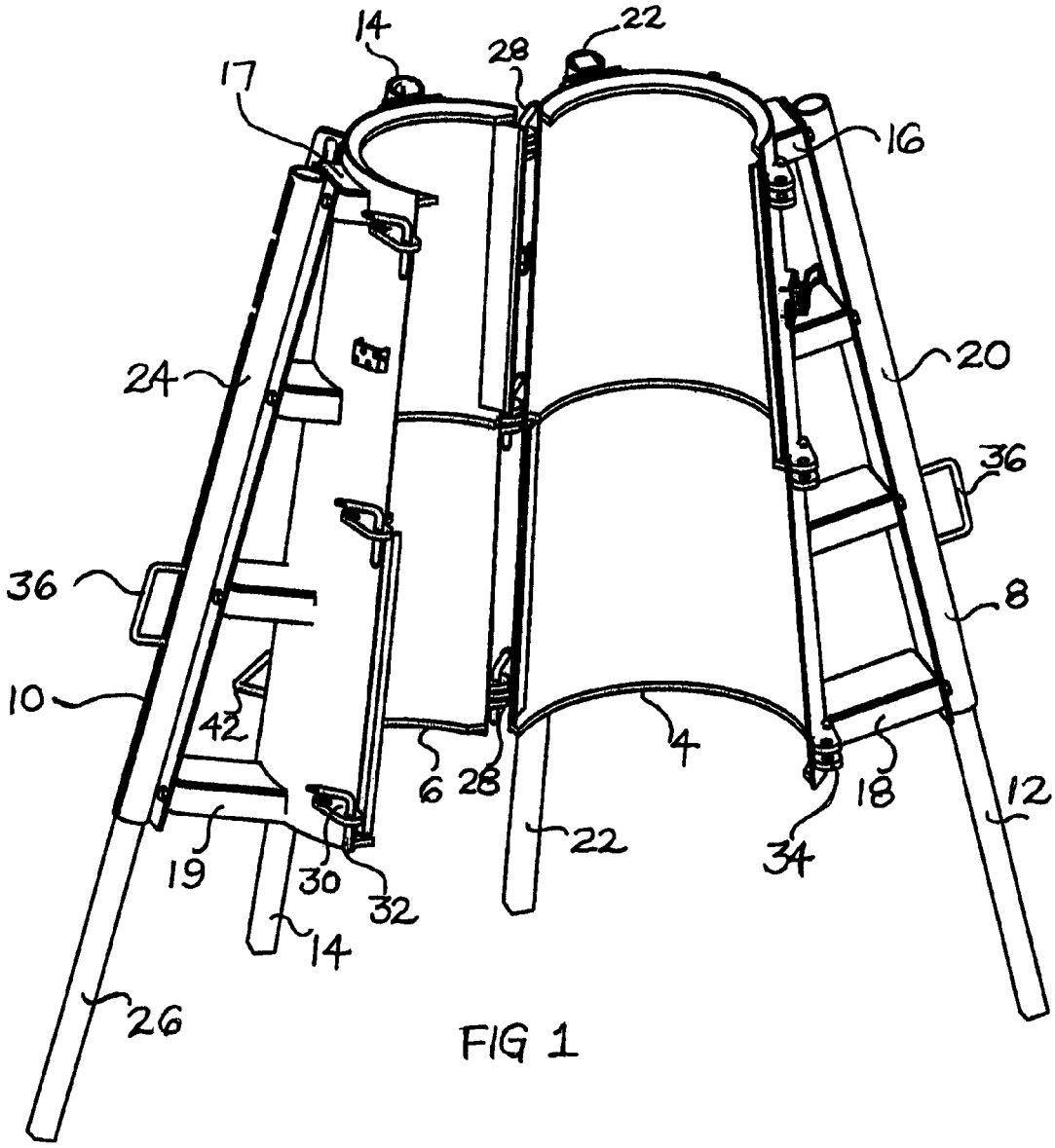
FIG. 1 illustrates a perspective view of the safety shield in a semi-open position.

As seen in FIG. 1, the rotary drill stem safety shield 2 is constructed of a first upright conically shaped half shell 4 and a second upright conically shaped half shell 6, which are hinged together along one upright elongated side. Mounted on the exterior of the first conical half shell 4 are a pair of extendible leg assemblies, the first leg assembly 8 being fully visible, with the lower leg 22 of the second leg assembly also being shown. A pair of extendible leg assemblies are also mounted on the second conical half shell 6, the second leg assembly 10 being fully visible and the leg 14 of the other assembly also being visible. The first leg assembly 8 is mounted on the exterior of the first conical half shell 4 by a short leg mount 16 at the top, a longer leg mount 18 at the bottom, and a pair of intermediate length leg mounts in between. As seen in FIG. 1, the first leg assembly 8 extends outwardly in a downward direction at an angle to the first conical half shell 4 in a quadrapodal manner. The first leg assembly 8 is constructed of a hollow cylindrical outer first leg housing 20 with an extendible leg 12 protruding from the interior of the bottom of the first tubular leg housing 20. The construction of the second leg assembly 10 is similar and includes a second hollow cylindrical leg housing 24 and a downwardly extendible leg 26. The second leg assembly 10 is connected to the exterior of the second conical half shell 6 by a series of mounts 17, 19 and intermediate mounts similar to mounts 16 and 18 and the intermediate mounts connecting the first leg assembly 8 to the first conical half shell 4. The bottoms of the extendible legs 14 and 22 of the other two leg assemblies are secured to the first and second conical half shells 4 and 6 in the same manner as the first and second leg assemblies 8 and 10.

The first conical half shell 4 and the second conical half shell 6 are hinged together along a vertical elongated side in clamshell-like manner by a series of hinges 28. Alternatively, the hinges 28 can be latches with pins and receptacles. The vertical elongated sides of the first and second conical half shells 4 and 6 opposite the hinges 28 can be secured together by a series of latches 30 with extendible pins 32 arranged above one another on the free vertical side of shell 6. When the shells 4 and 6 are closed together, the pins 32 fit within receptacles 34 which are arranged above one another on the free vertical side of shell 4. One hand hold 36 is secured to each respective leg 12, 14, 22 and 26. Hand holds are also secured to the exterior of the first and second conical half shells 4 and 6, one of which is partially visible in FIG. 1.

Figure 2:
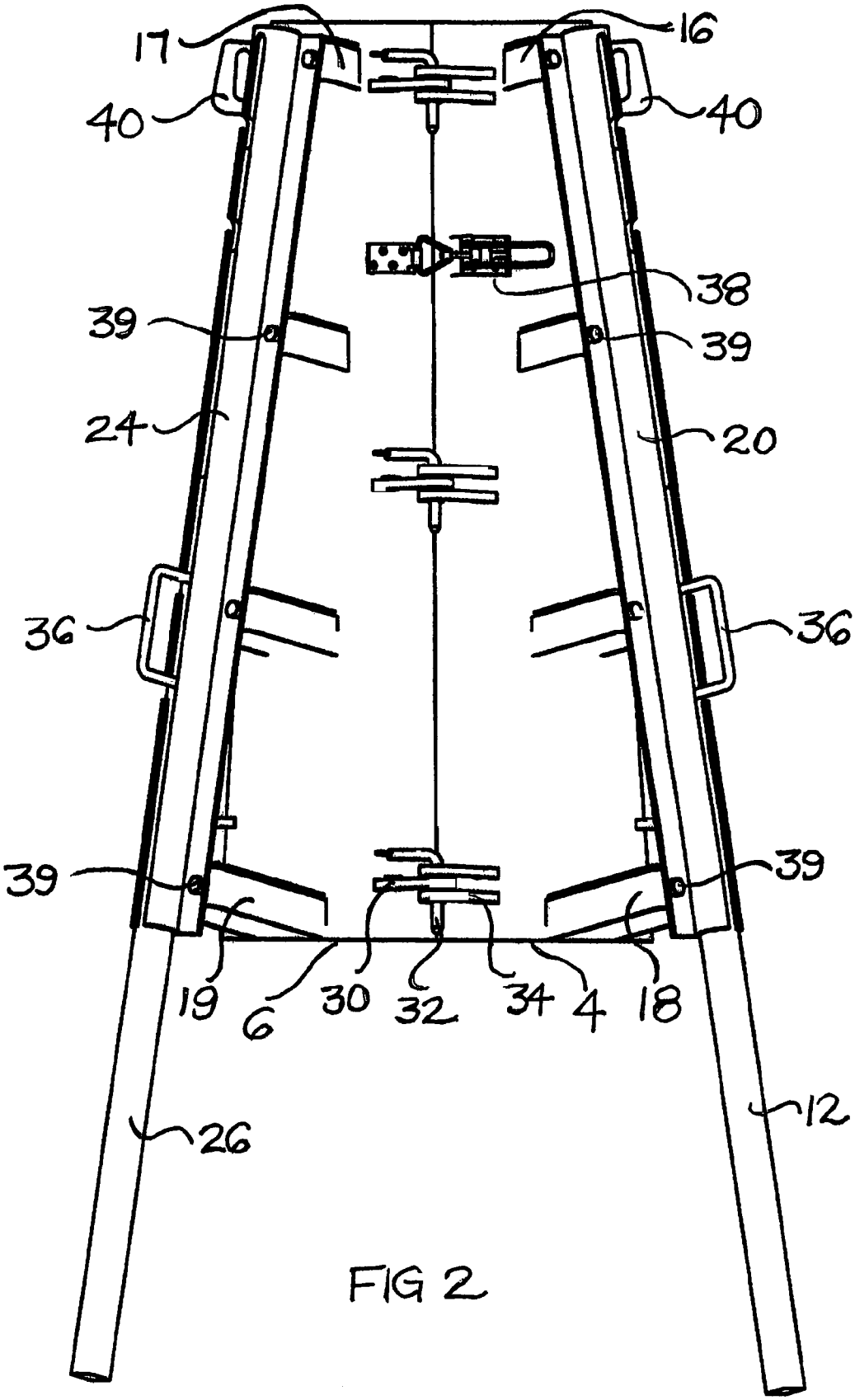
FIG. 2 illustrates a front view of the hinged side of the safety shield, in a closed position.

FIG. 2 illustrates a front view of the hinged side of the safety shield, in a closed position. As seen in FIG. 2, the two half shells 4 and 6 and closed together and the vertical series of pins 32 are respectively secured in the corresponding series of receptacles 34. A safety lock 38, which can be closed and padlocked, is also shown between the top and middle latches and pins. FIG. 2 also shows the leg assemblies 20 and 24, with legs 12 and 26 mounted on the exterior of the two half shells 4 and 6 by the series of mounts 16, 17, 18 and 19. Handles 36 are also visible. The leg assemblies 20 and 24 are secured to the mounts 16, 17, 18 and 19 and intermediate mounts by a series of bolts 39.

Figure 3:
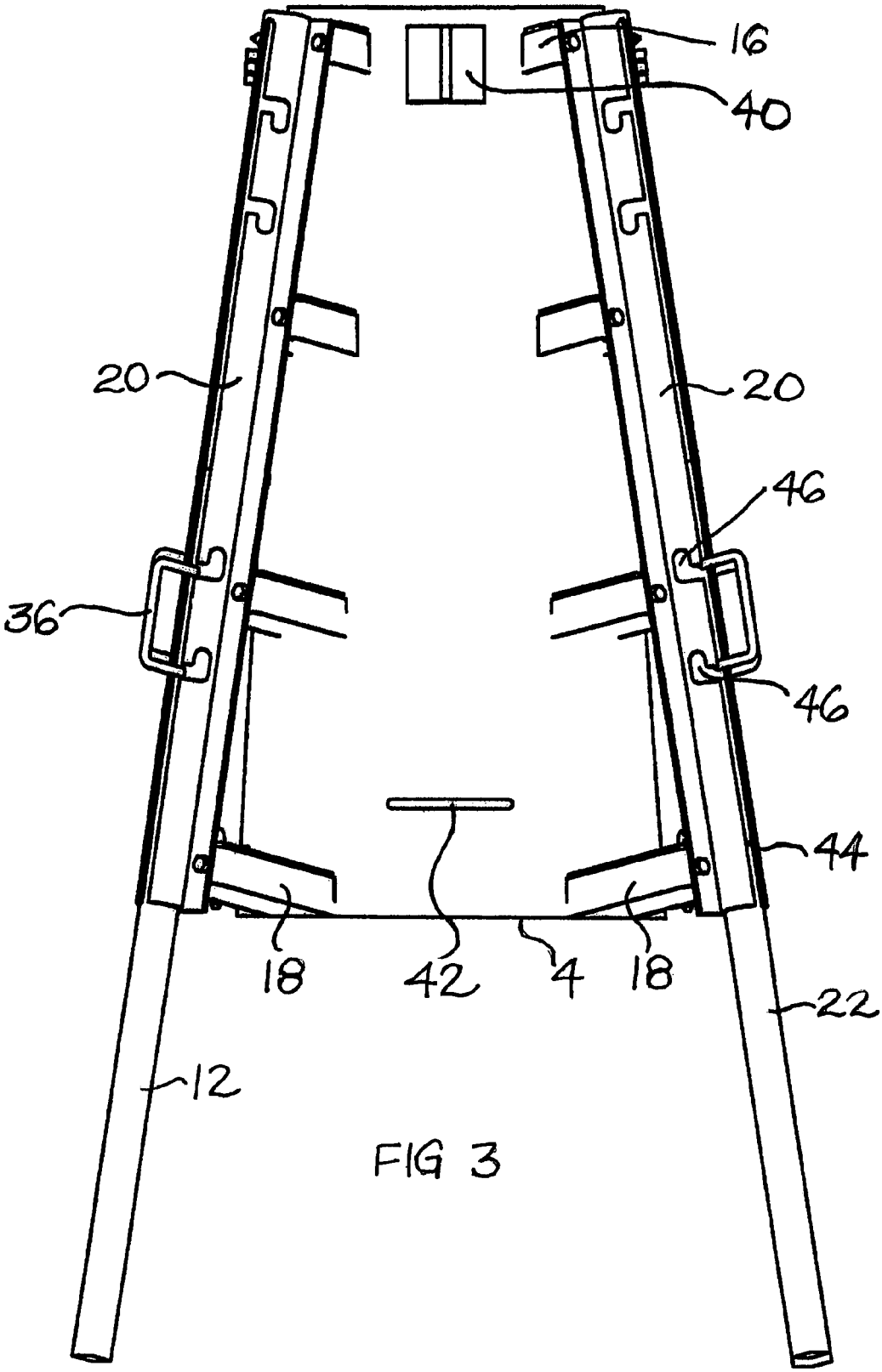
FIG. 3 illustrates a side view of the safety shield.

FIG. 3 illustrates a side view of the exterior of conical shell 4 of the safety shield. While FIG. 3 illustrates the same basic components that are shown and discussed in FIGS. 1 and 2 above. FIG. 3 also shows a lifting lug 40 at the top region of the half shell 4, and a horizontal handle 42 at the bottom region of the half shell 4. FIG. 3 is also notable for illustrating how the extendible inner legs 12 and 22 can be secured at various desired elevations in the interior of the cylindrical outer housings 20 by the handles 36 of inner legs 12 and 22 being moved in elongated slots 44 and rotated into lock slots 46.

Figure 4:
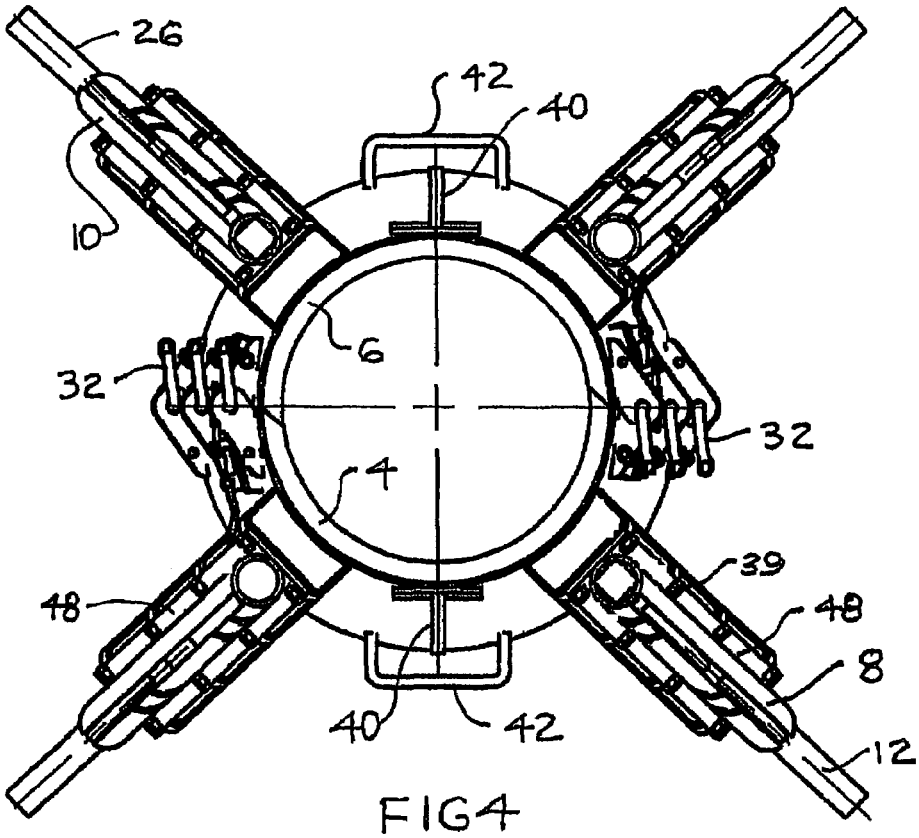
FIG. 4 illustrates a top view of the safety shield.
Figure 5:
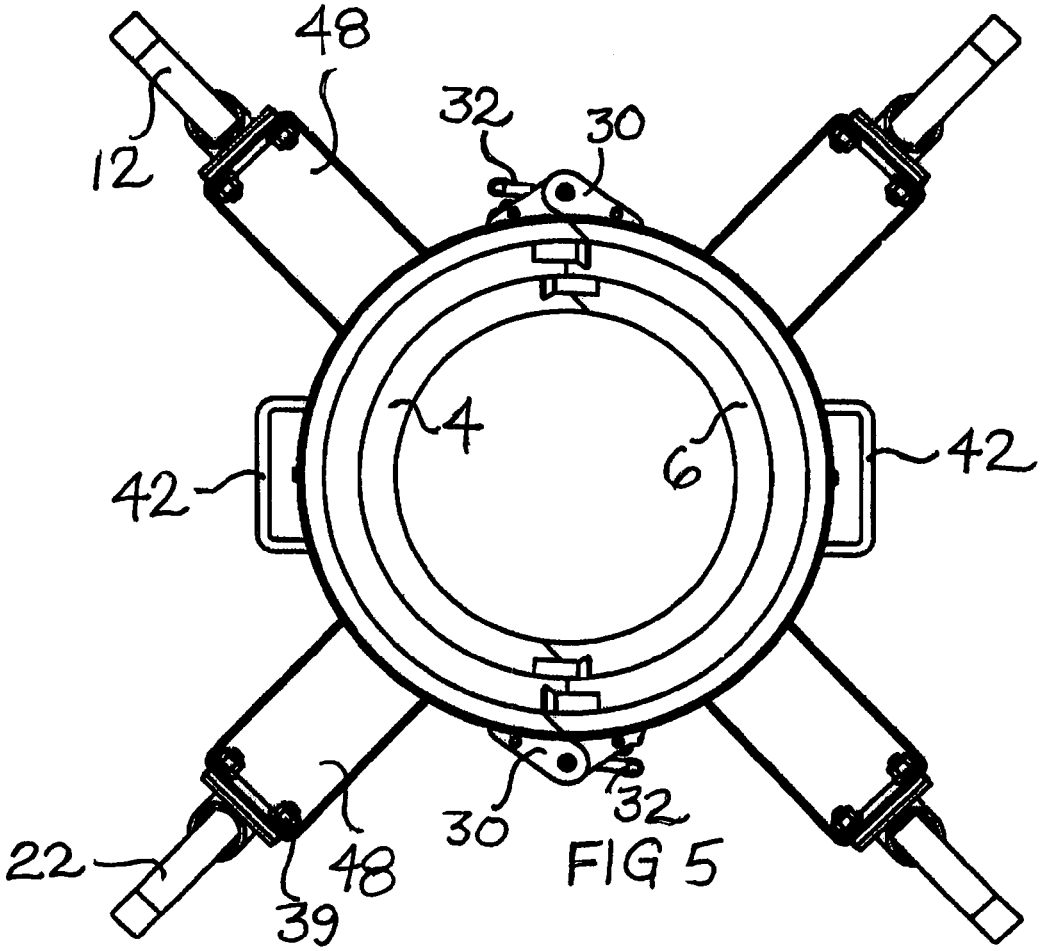
FIG. 5 illustrates a bottom view of the safety shield.

FIG. 4 illustrates a top view of the safety shield. FIG. 5 illustrates a bottom view of the safety shield. In particular, FIGS. 4 and 5 show the two half shells 4 and 6, the four leg assemblies, the lifting lugs 40 and handles 36 on the two half shells. FIG. 4 also shows a variation of the safety shield where two sets of latches 30, pins 32 and receptacles are used, one set replacing the hinges on one side. This configuration enables the two half shells to be separated from one another for shipping, storage or other purposes.

Figures 6, 7, 11:
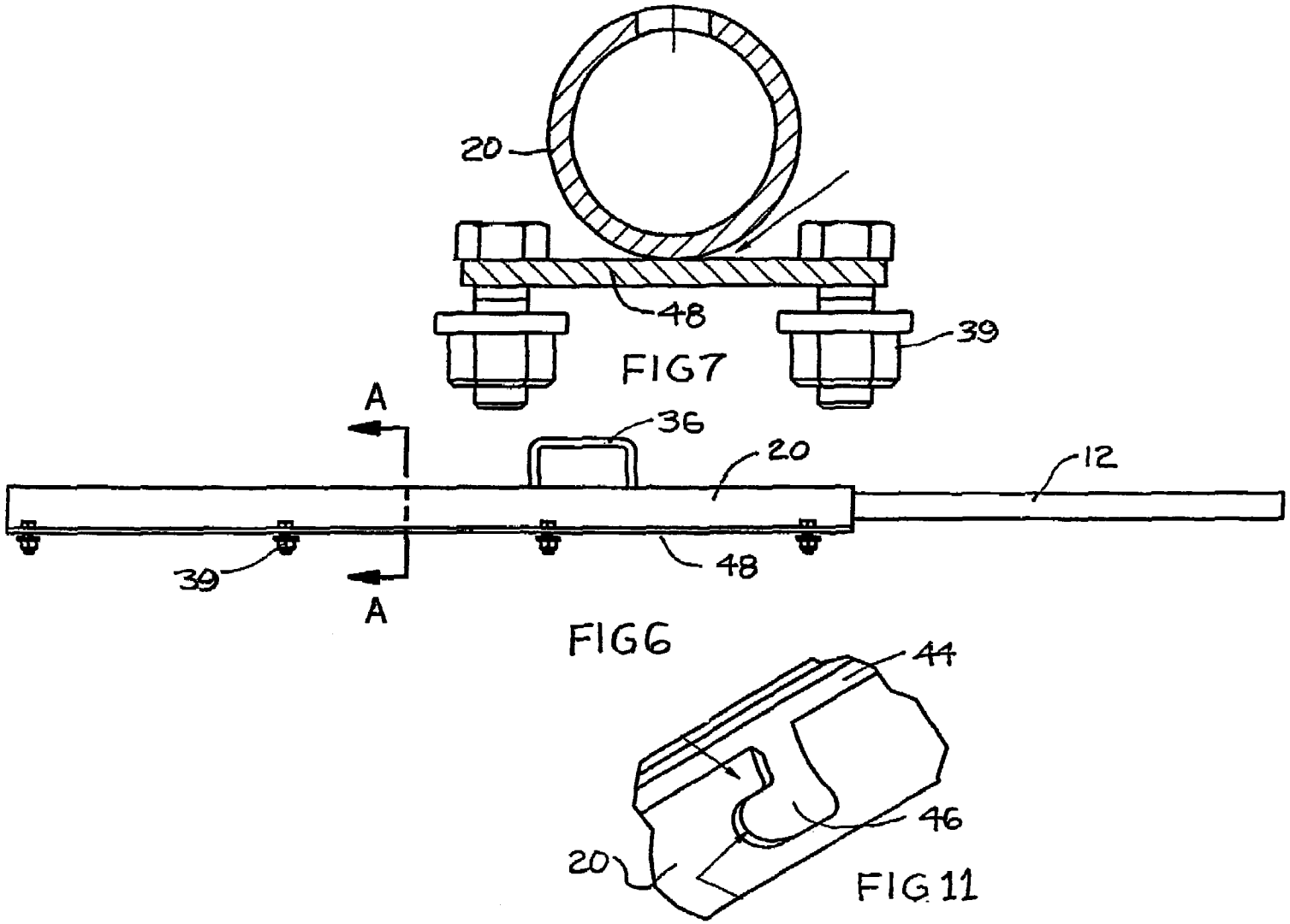
FIG. 6 illustrates a front view of an inner and outer extendible leg assembly.
FIG. 7 illustrates a section of A-A taken through FIG. 6.
FIG. 11 illustrates a detail taken of A-A of FIG. 10 of a part of an outer leg housing with slot and lock opening.

FIG. 6 is a front view of an inner and outer leg assembly. As seen in FIG. 6, the cylindrical outer leg housing 20 is secured to one side of an elongated plate 48 by welding or other securing techniques. The inner extendible leg 12 is square in cross-section and extends out of the interior of the outer cylindrical leg housing 20. FIG. 7 is a section view taken along section lines A-A of FIG. 6 and shows outer housing 20, plate 48 and bolts 39.

Figure 8:
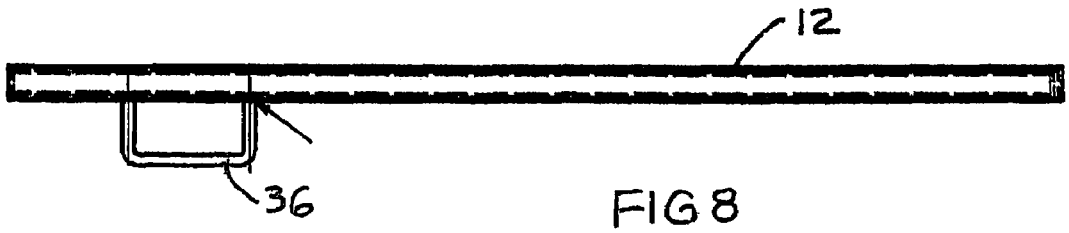
FIG. 8 illustrates a cut-away view of an inner leg fitted inside an outer leg housing.
Figure 9:
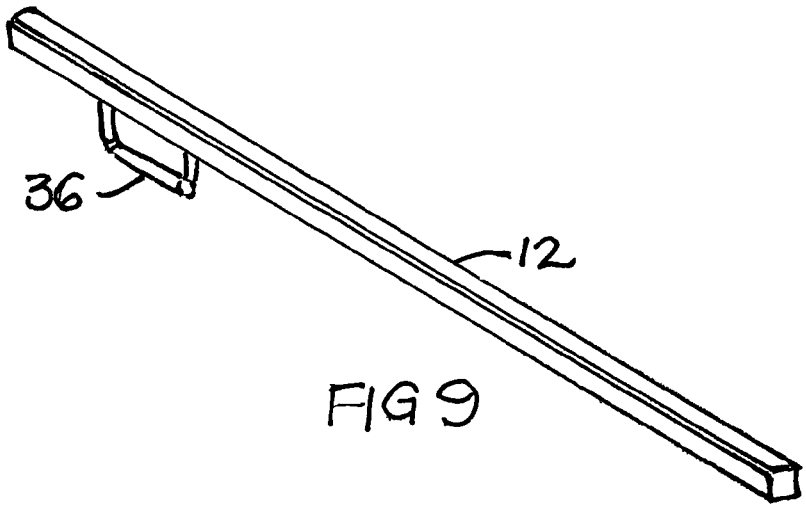
FIG. 9 illustrates an isometric view of an inner leg with handle.

FIG. 8 is a cut-away view of an inner leg 12 with protruding handle 36. FIG. 9 is an isometric view of the inner leg 12 with handle 36, showing the square cross-section.

Figure 10:
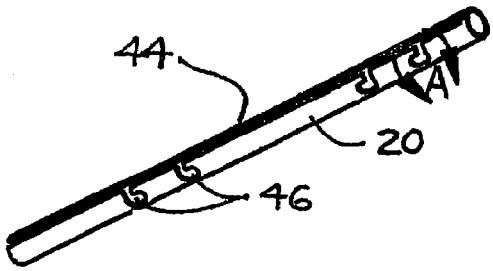
FIG. 10 illustrates an isometric view of an outer leg housing with linear slot and lock openings.

FIG. 10 is an isometric view of an outer leg housing 20 with linear slot and lock openings. FIG. 11 is a detail A-A of FIG. 10 showing a part of an outer leg housing with slot and lock opening. FIGS. 10 and 11 illustrate the longitudinal slot 44 that extends the length of the outer leg 20 and enables the handle 36 of the inner leg 12 to be moved longitudinally in the outer leg 20. When the inner leg 12 is positioned within outer leg 20 at the desired degree of protrusion by moving handle 36, the handle 36 is rotated 90° into the pair of L-shaped slots 46 to lock the inner leg 12 into position.

EXAMPLE

A prototype of the safety shield has been constructed and tested on an oil rig. The prototype safety device is 4 ft. tall, has a 14 in. inside diameter top and a 20 in. inside diameter bottom with the appearance of an inverted hollow cone. The safety device was constructed in the form of two conical half shells which are hinged together for installation around the drill string of the oil or gas drilling rig when drilling the surface hole stage of the procedure and a conductor pipe has not been preset. The two half shells were secured together by pins through pin pockets. Once installed, the four legs were extended down to elevate the device two feet above ground level. This leaves a space which is necessary for enabling return drilling fluid (mud) to flow under the device to the trash pump to the shale shaker.

The prototype was constructed of aluminum alloy material for lightness, with the only exception being the securing pins, which are of stainless steel to resist corrosion.

The safety device, when installed on the ground below the drill rig platform, provides a protective wall between any worker in the area, the rotating drill string and the annular hole between the drill string and the surrounding ground.

As an option, a 17 inch wide "pipe wiper (stripper)" was installed over the drill string to prevent undesired iron or articles from being dropped down the wellbore, therefore avoiding costly "fishing operations". The safety device is ideal for use on new wells that have not previously been drilled and cased with a cemented in "conductor pipe".

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

What is claimed is:

1. A safety shield for use in association with rotary drilling rigs comprising:

(a) a first protective shield;

(b) a second protective shield associated with the first shield;

(c) a first extendable length leg assembly connected to the exterior of the first shield;

(d) a second extendable length leg assembly secured to the exterior of the second shield; and (e) a securing mechanism for securing the first shield to the second shield.

2. A safety device as claimed in claim 1 wherein the first protective shield and the second protective shield are formed in the shape of hollow conical half shells, which when placed together form a hollow truncated cone.

3. A safety device as claimed in claim 2 wherein the first protective shield and the second protective shield are hinged together.

4. A safety shield as claimed in claim 2 wherein the first leg assembly and the second leg assembly are secured to the exterior of the first and second half shells by a series of mounts.

5. A safety shield as claimed in claim 2 including a pair of leg assemblies secured to the exterior of the first shell and a pair of leg assemblies secured to the exterior of the second shell.

6. A safety shield as claimed in claim 2 including a handle mounted on the exterior of the first shell and a handle mounted on the exterior of the second shell.

7. A safety shield as claimed in claim 1 wherein the first and second leg assemblies are formed of a first outer component and a second inner component which can be moved relative to the first outer component to adjust the respective lengths of the assemblies.

8. A safety shield as claimed in claim 7 wherein the first outer component has a slot therein and the second inner component has a handle thereon which protrudes through the slot and enables the second inner component to be moved in the slot relative to the first outer component.

9. A safety shield as claimed in claim 8 wherein the handle can be locked into position in the first outer component.

10. A safety shield as claimed in claim 9 wherein the first outer component has a lock slot therein in which the handle of the second inner component can be locked.

* * * * *